US011572669B2

(12) United States Patent
Harshman

(10) Patent No.: US 11,572,669 B2
(45) Date of Patent: Feb. 7, 2023

(54) CIRCLE DRIVE CONTROL SYSTEM FOR A GRADING MACHINE

(71) Applicant: Caterpillar Inc., Deerfield, IL (US)

(72) Inventor: Nathaniel K. Harshman, Sullivan, IL (US)

(73) Assignee: Caterpillar Inc., Peoria, IL (US)

( * ) Notice: Subject to any disclaimer, the term of this patent is extended or adjusted under 35 U.S.C. 154(b) by 737 days.

(21) Appl. No.: 16/502,338

(22) Filed: Jul. 3, 2019

(65) Prior Publication Data

US 2021/0002856 A1 Jan. 7, 2021

(51) Int. Cl.
*E02F 3/84* (2006.01)
*E02F 3/76* (2006.01)

(52) U.S. Cl.
CPC ..... *E02F 3/844* (2013.01); *E02F 3/764* (2013.01)

(58) Field of Classification Search
CPC ..... E02F 3/764; E02F 3/844; E02F 3/845
See application file for complete search history.

(56) References Cited

U.S. PATENT DOCUMENTS 3,899,028 A * 8/1975 Morris ..... E02F 3/764 172/4.5
4,773,302 A * 9/1988 Mizota ..... E02F 9/2041 414/700
6,851,486 B2 * 2/2005 Marshall ..... E02F 3/7654 172/795
9,228,316 B2 1/2016 Staade et al.
9,469,967 B2 10/2016 Edara et al.
9,540,787 B2 1/2017 West et al.
10,753,065 B2 * 8/2020 Ono ..... E02F 3/8157
10,815,645 B2 * 10/2020 Peat ..... E02F 3/844
11,001,988 B2 * 5/2021 Gentle ..... E02F 9/2025
2013/0304331 A1 11/2013 Braunstein et al.
2016/0032566 A1 * 2/2016 Taddia ..... F15B 13/0417 60/463
2020/0173140 A1 * 6/2020 Gentle ..... E02F 3/844
2021/0123208 A1 * 4/2021 Vahling ..... E02F 9/2079

FOREIGN PATENT DOCUMENTS

CN 102416940 A 4/2012
JP 2003261958 A 9/2003
KR 101770916 B1 8/2017

* cited by examiner

*Primary Examiner* — Gary S Hartmann
(74) *Attorney, Agent, or Firm* — Harrity & Harrity, LLP

(57) ABSTRACT

A control system for a grading machine includes a circle angle sensor coupled to a circle. The circle is coupled to and supports a grading blade, and the circle angle sensor is configured to measure an angular position of the circle. The control system also includes a blade load sensor configured to measure a load on the grading blade. The control system also includes a circle drive system including a circle drive motor and a controller. The circle drive motor is configured to engage with and rotate the circle around a circle axis, and the controller is configured to control the rotation of the circle under a circle rotation command by monitoring the angular position of the circle and the load on the grading blade.

20 Claims, 4 Drawing Sheets

CIRCLE DRIVE CONTROL SYSTEM FOR A GRADING MACHINE

TECHNICAL FIELD

The present disclosure relates generally to a grading machine, and more particularly, to a circle drive control system for a grading machine.

BACKGROUND

The present disclosure relates to mobile machines that are used in grading. Grading machines are typically used to cut, spread, or level material that forms a ground surface. To perform such earth sculpting tasks, grading machines include a blade, also referred to as a moldboard or implement. The blade moves relatively small quantities of earth from side to side, in comparison to a bulldozer or other machine that moves larger quantities of earth. Grading machines are frequently used to form a variety of final earth arrangements, which often require the blade to be positioned in different positions and/or orientations depending on the sculpting task and/or the material being sculpted. The different blade positions may include the blade cutting angle.

A circle drive may control a position of a circle coupled to the blade, and thus adjust the blade cutting angle. Different blade positions may require different amounts of torque in order to adjust the blade, especially when the blade is engaged with material. Rotating the circle and blade while the blade is under an excessive load can lead to slippage in the circle drive, excessive heat generation, and wear of the clutch and other gear train components.

U.S. Pat. No. 9,540,787, issued to West et al. on Jan. 10, 2017 ("the '787 patent"), describes an apparatus for positioning a circle and a moldboard relative to a frame of a grading machine. The '787 patent includes a circle drive motor to control the circle and the moldboard, and the circle drive motor is coupled to a gear apparatus with an output shaft configured to mesh with and rotate the circle relative to the machine frame. The '787 patent includes a system for monitoring the operation of a hydraulic circle drive motor and monitoring pressure at a hydraulic pump. The '787 patent disables the hydraulic motor if an excessive hydraulic pressure is detected. However, the '787 patent does not monitor the position or the movement of the circle and the moldboard, along with the load on the moldboard, to help prevent damage to the circle drive motor or other components of the circle drive system.

The system for a grading machine of the present disclosure may solve one or more of the problems set forth above and/or other problems in the art. The scope of the current disclosure, however, is defined by the attached claims, and not by the ability to solve any specific problem.

SUMMARY

In one aspect, a control system for a grading machine may include a circle angle sensor coupled to a circle. The circle may be coupled to and support a grading blade, and the circle angle sensor may be configured to measure an angular position of the circle. The control system also may include a blade load sensor configured to measure a load on the grading blade. The control system also may include a circle drive system including a circle drive motor and a controller. The circle drive motor may be configured to engage with and rotate the circle around a circle axis, and the controller may be configured to control the rotation of the circle under a circle rotation command by monitoring the angular position of the circle and the load on the grading blade.

In another aspect, a method for operating and monitoring a grading machine may include receiving a circle rotation command, where the circle rotation command includes a positioning of a circle coupled to a grading blade, and determining whether a load on the grading blade is below a threshold. Upon determining that the load on the grading blade is below the threshold, the method may include initiating the circle rotation command by driving the circle with a circle drive system. Upon determining that the load on the grading blade is not below the threshold, the method may include disabling the circle rotation command.

In yet another aspect, a control system for a grading machine may include a circle angle sensor coupled to a circle. The circle may be coupled to and support a grading blade, and the circle angle sensor may be configured to measure an angular position of the circle. The control system may also include a circle drive system including a circle drive motor and a controller. The circle drive motor may be configured to engage with and rotate the circle around a circle axis, and the controller may be configured to control the rotation of the circle under a circle rotation command by monitoring an angular position of the circle. In response to the circle rotation command, the controller may be configured to determine whether the circle is rotating, and upon determining that the circle is not rotating, the controller may disable the circle rotation command.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces or materials that may be worked in material moving procedures (e.g., gravel, clay, sand, dirt, etc.) and/or can be cut, spread, sculpted, smoothed, leveled, graded, or otherwise treated. In this disclosure, unless stated otherwise, relative terms, such as, for example, "about," "substantially," and "approximately" are used to indicate a possible variation of ±10% in the stated value.

Figure 1:
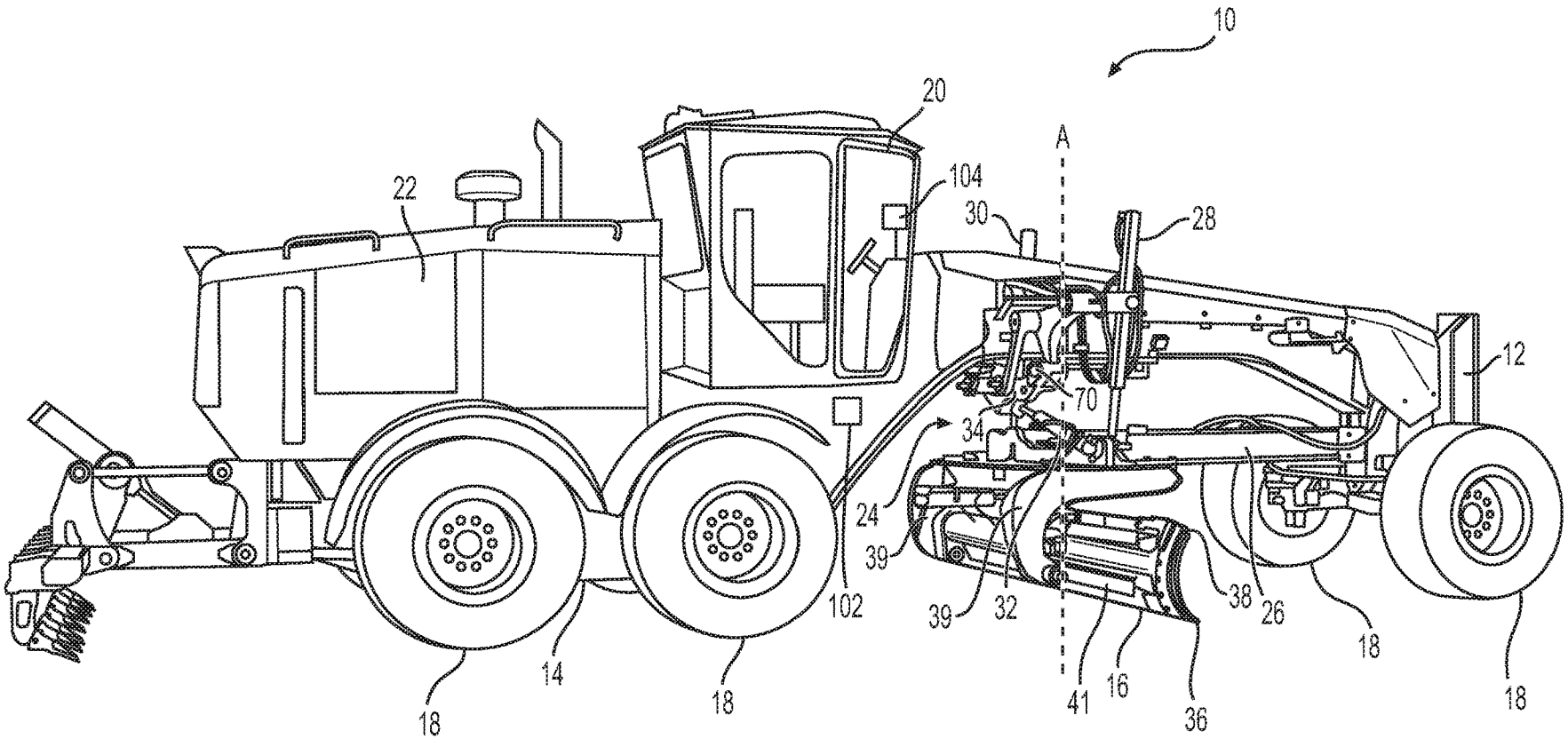
FIG. 1 is an illustration of an exemplary grading machine, according to aspects of this disclosure.

FIG. 1 illustrates a perspective view of an exemplary motor grader 10 (hereinafter "motor grader"), according to the present disclosure. Motor grader 10 includes a front frame 12, a rear frame 14, and a blade 16. Front frame 12 and rear frame 14 are supported by wheels 18. An operator cab 20 may be mounted above a coupling of front frame 12 and rear frame 14, and may include various controls, display units, touch screens, or user interfaces, for example, user interface 104, to operate or monitor the status of the motor grader 10. Rear frame 14 also includes an engine 22 to drive and/or power motor grader 10. Blade 16, sometimes referred to as a moldboard, is used to cut, spread, or level (collectively "sculpt") earth or other material traversed by motor grader 10. As shown in greater detail in FIG. 2, blade 16 is mounted on a linkage assembly, shown generally at 24. Linkage assembly 24 allows blade 16 to be moved to a variety of different positions and orientations relative to motor grader 10, and thus sculpt the traversed ground surface in different ways. Additionally, a circle drive system 40 may include or be coupled to a motor, and circle drive system 40 may include a gearing arrangement in order to engage with and rotate a circle 46 (FIGS. 1 and 2) in order to adjust at least one aspect of blade 16.

Additionally, a controller 102 may be in communication with one or more features of motor grader 10 and receive inputs from and send outputs to, for example, user interface 104 in cab 20 or an interface remote from motor grader 10. In one aspect, motor grader 10 may be an electrohydraulic motor grader, and controller 102 may control one or more electrical switches or valves in order to control one or more hydraulic cylinders or electrical elements in order to operate motor grader 10. Moreover, as discussed below with respect to FIGS. 2 and 3, a plurality of sensors may be in communication with controller 102.

Starting at the front of the motor grader 10 and working rearward toward the blade 16, linkage assembly 24 includes a drawbar 26. Drawbar 26 is pivotably mounted to the front frame 12 with a ball joint (not shown). The position of drawbar 26 may be controlled by hydraulic cylinders, including, for example, a right lift cylinder 28, a left lift cylinder 30, a centershift cylinder 32, and a linkbar 34. A height of blade 16 with respect to the surface being traversed below motor grader 10, commonly referred to as blade height, may be primarily controlled and/or adjusted with right lift cylinder 28 and left lift cylinder 30. Right lift cylinder 28 and left lift cylinder 30 may be controlled independently and, thus, may be used to tilt a bottom of blade 16, which includes a bottom cutting edge 36 and a top edge 38. Based on the positions of right lift cylinder 28 and left lift cylinder 30, cutting edge 36 may be tilted relative to the traversed material, so lift cylinders 28 and 30 may control a blade tilt. Right lift cylinder 28 and left lift cylinder 30 may also be used (e.g., extended or retracted simultaneously) to control the height of blade 16 relative to motor grader 10 in order to control depth of the cut into the ground surface or a height of blade 16 above the ground surface. For example, for an aggressive cut or sculpting procedure, right lift cylinder 28 and left lift cylinder 30 may be extended such that blade 16 is extended away from motor grader 10 to a lower depth. On the other hand, if motor grader 10 is performing a light sculpting procedure, is traversing a ground surface between sculpting procedures, or where it is otherwise desirable for blade 16 to not contact the ground surface, right lift cylinder 28 and left lift cylinder 30 may be retracted such that drawbar 26 and blade 16 are lifted up toward motor grader 10.

Centershift cylinder 32 and linkbar 34 may be used primarily to shift a lateral position of drawbar 26, and any components mounted to drawbar 26, relative to front frame 12. This lateral shifting is commonly referred to as drawbar centershift. Centershift cylinder 32 may include one end coupled to drawbar 26, and another end pivotably coupled to linkbar 34. Linkbar 34 may include a plurality of position holes 70 for selectively positioning centershift cylinder 32 to the left or to the right to allow for further shifting of drawbar 26 to a left or to a right side of the motor grader 10 by centershift cylinder 32.

Figure 2:
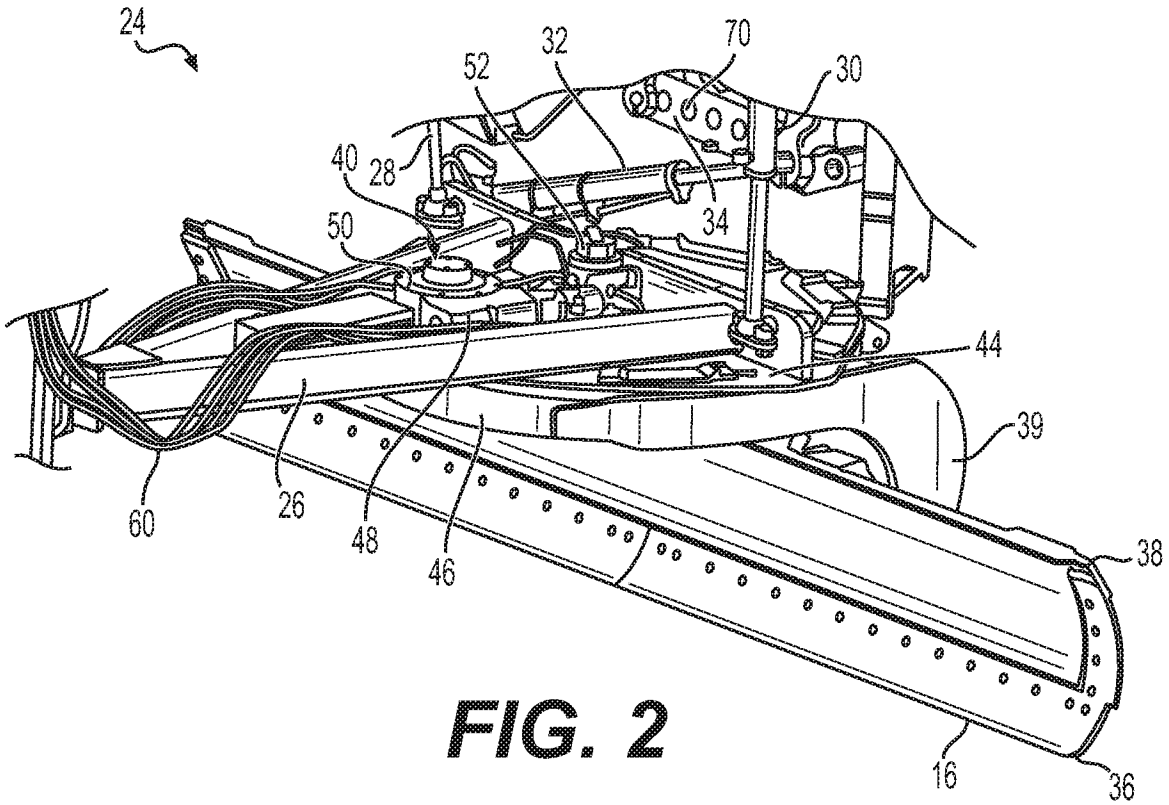
FIG. 2 is a perspective view of the grading portion of the grading machine of FIG. 1.

As shown in FIG. 2, drawbar 26 is coupled to a large, flat plate, commonly referred to as a yoke plate 44. Beneath yoke plate 44 is a large gear, commonly referred to as circle 46. Although not shown, circle 46 may include a plurality of teeth that extend along an inner portion of circle 46. Circle 46 and blade 16 may be coupled via support arms 39 and a support plate 41 (FIG. 1).

Circle 46 may be rotated by circle drive system 40. Circle drive system 40 may include a circle drive motor 48 and a gear box 50. Circle drive motor 48 may be a hydraulic motor coupled to one or more hydraulic lines 60, and may be in communication with controller 102 and/or user interface 104. Alternatively, circle drive motor 48 may be an electric motor or any other appropriate type of motor. Circle drive motor 48 may be any motor that includes or is coupled to a rotational output shaft, for example, a gear motor, a vane motor, an axial plunger motor, a radial piston motor, etc.

Gear box 50 may be directly coupled to circle drive motor 48, or may be coupled to circle drive motor 48 via a gear coupling (not shown). As shown in FIG. 2, gear box 50 may be laterally adjacent to circle drive motor 48. Moreover, gear box 50 may include any gear arrangement to drive the rotation of circle 46, for example, one or more epicyclic or planetary gear assemblies, one or more spur gears, one or more worm gears, etc. Although not shown, gear box 50 may include an output shaft that engages with teeth on the inner portion of circle 46 to rotate circle 46. The rotation of circle 46 by circle drive system 40 adjusts a circle angle and pivots blade 16 about an axis A (FIG. 1) fixed to drawbar 26 to establish a blade cutting angle. The blade cutting angle is defined as the angle of blade 16 relative to front frame 12, and the blade cutting angle may be controlled by a combination of the position of circle 46 and the position of drawbar 26.

Based on the effect of circle drive system 40, circle 46 and blade 16 may be rotated clockwise or counterclockwise relative to front frame 12 about axis A. In one aspect, circle 46 and blade 16 may be rotated up to approximately 75 degrees clockwise or counterclockwise about axis A. In another aspect, circle 46 and blade 16 may be rotated 360 degrees clockwise or counterclockwise about axis A. In either aspect, at a 0 degree blade cutting angle, blade 16 is arranged at a right angle to the front frame 12. Furthermore, a circle angle sensor 52 may be positioned on circle 46. As discussed in detail below, circle angle sensor 52 may help measure an angular rotation of circle 46, and thus the cutting angle of blade 16.

As shown in FIGS. 1 and 2, motor grader 10 may include a plurality of hydraulic lines 60 in order to control the hydraulic cylinders and/or hydraulic motors. Motor grader 10 may include a hydraulic pump (not shown). The hydraulic pump may supply high pressure hydraulic fluid through one or more of hydraulic lines 60 to one or more of the hydraulic cylinders to control the movement of the hydraulic cylinders. Additionally, each hydraulic cylinder may include an electrical solenoid and one or more hydraulic valves. The solenoid may receive one or more signals from controller 102 to control and position each hydraulic cylinder by configuring the flow of hydraulic fluid through the valves. The delivery of the hydraulic fluid may be controlled by controller 102, for example, via user interface 104. In one aspect, controller 102 controls the delivery of hydraulic fluid through hydraulic lines 60 to circle drive motor 48 to control the position of circle 46 and blade 16. For example, the delivery of the hydraulic fluid may be controlled based on a user requested mode, desired position, etc., which may be input via user interface 104.

Figure 3:
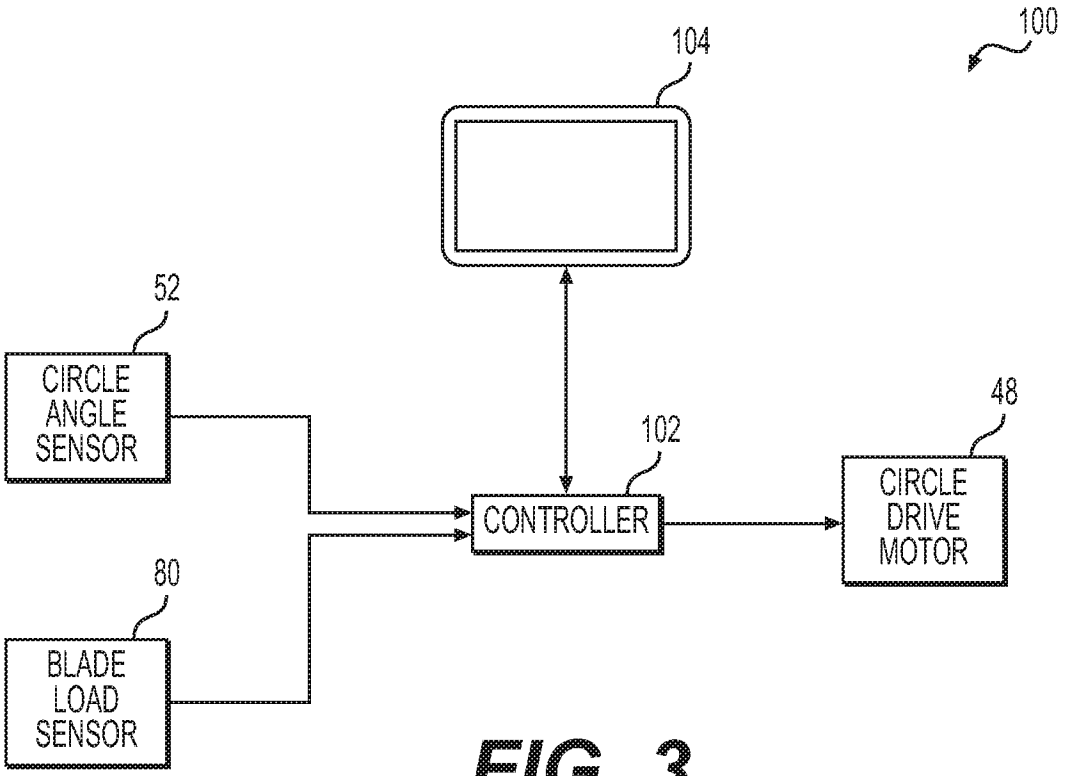
FIG. 3 is a schematic view of a portion of a control system for the exemplary machine of FIG. 1.
Figure 4:
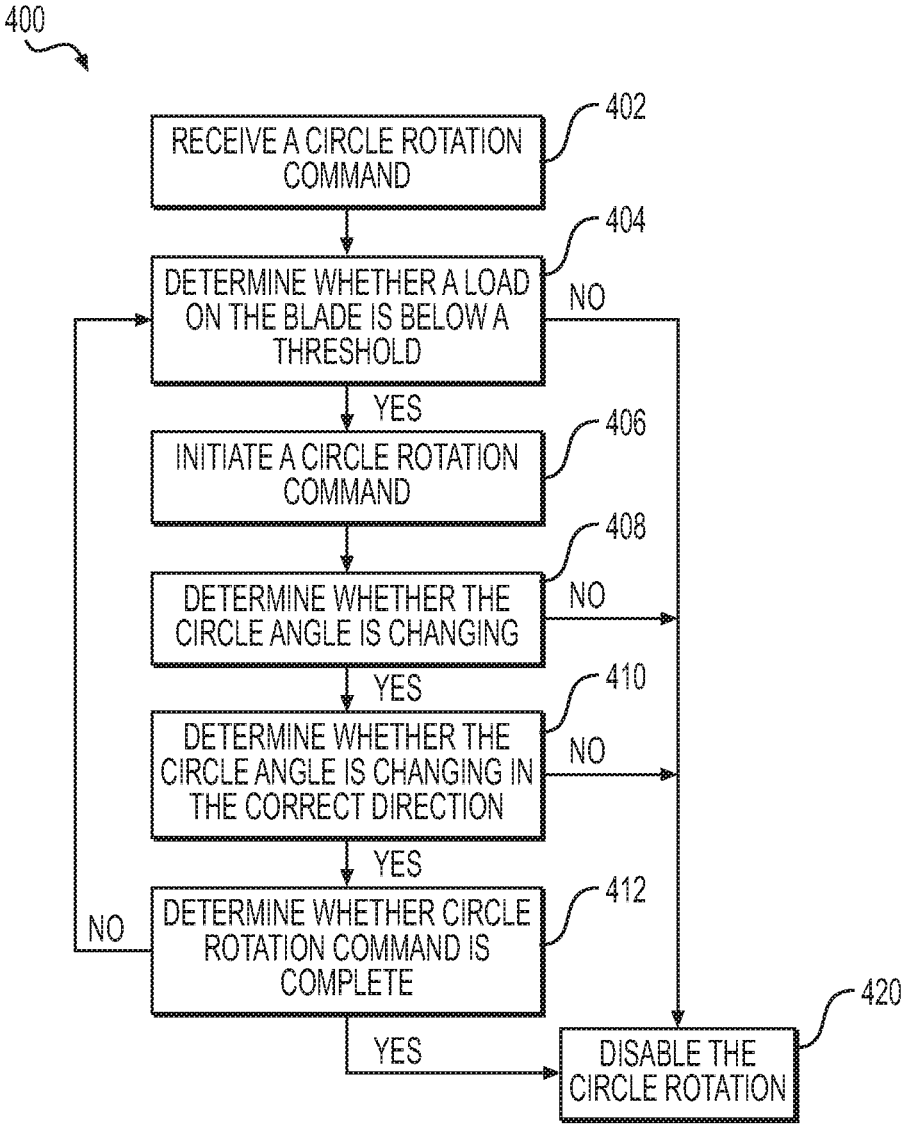
FIG. 4 provides a flow chart depicting an exemplary method for monitoring and/or controlling the position of a circle during a grading operation.

FIG. 3 illustrates a schematic view of a control system 100. As shown, control system 100 includes controller 102 and user interface 104. Control system 100 may include circle drive motor 48, circle angle sensor 52, and a blade load sensor 80. As discussed below, FIG. 4 illustrates an exemplary method that may be performed by control system 100 to monitor and/or control the rotation of circle 46 during a grading operation.

Controller 102 may be a separate controller on motor grader 10 or may be integrated into a central machine controller (e.g., a main motor grader control module). Alternatively, controller 102 may be integrated into a blade controller, an engine control module, or another control module on motor grader 10. Controller 102 may be in communication with and receive signals from circle angle sensor 52. Additionally, controller 102 may be in communication with and receive signals from blade load sensor 80. Controller 102 may be in communication with a display and/or input device, for example, user interface 104, in order to receive operator input, display sensed information, signal alerts or notifications, etc. Additionally, controller 102 may be in communication with circle drive motor 48, for example, in order to adjust the position of circle 46 and blade 16.

As mentioned, circle angle sensor 52 is positioned on circle 46 to measure an angular rotation of circle 46, and thus an angle of blade 16. Circle angle sensor 52 may be, for example, a rotary sensor, an inertial measurement unit, etc. In one aspect, circle angle sensor 52 may be mounted in a centered position on circle 46. In another aspect, circle angle sensor 52 may be mounted in an off-centered position on circle 46, and circle angle sensor 52 or other internal components of motor grader 10 may be used to calculate the position of circle 46 and blade 16 based on a compensation or correction to account for the off-centered position of circle angle sensor 52.

Blade load sensor 80 may be configured to sense at least one parameter associated with a load exerted on blade 16. For example, blade load sensor 80 may be a strain gauge load cell configured to measure a load on blade 16, or a hydraulic or hydrostatic system that measures a load exerted on one or more hydraulic components (not shown) associated with support and/or movement of blade 16. Alternatively, blade load sensor 80 may include any system or component that determines either the magnitude of the load exerted on blade 16 and/or whether the load exerted on blade 16 is above or below a threshold value, and which outputs one or more signals accordingly, for example, to controller 102. In another aspect, blade load sensor 80 may include and/or be coupled to any number of sensors configured to measure various parameters and help determine a load on blade 16, for example, an engine load or output sensor, lift cylinder position sensor(s), a blade pitch sensor, etc. In any of these aspects, the threshold value as measured by blade load sensor 80 may be a specified value, either user-selected or automatically selected, that may correspond to the structural aspects of circle drive system 40, for example, a threshold torque on one or more internal components of gear box 50.

INDUSTRIAL APPLICABILITY

The disclosed aspects of motor grader 10 may be used in any grading or sculpting machine to assist in positioning blade 16 and/or circle 46. Circle drive motor 48 may help an operator position and orient blade 16 and circle 46. Additionally, controller 102 and method 400 may help prevent damage to one or more of blade 16, circle 46, circle drive motor 48, and gear box 50 during the rotation and positioning of blade 16 and circle 46. As discussed above, controller 102 may perform method 400 during the initiation and/or during the entirety of a grading procedure. During method 400, controller 102 may monitor various aspects of motor grader 10 to help prevent damage to various components of motor grader 10, for example, prevent slippage in circle drive system 40, excessive heat generation, wear of a clutch or other gear train components, etc.

FIG. 4 is a flow diagram portraying an exemplary method 400 that may be performed by control system 100 to monitor and/or control the rotation of circle 46 during a grading operation. Method 400 includes a step 402, in which motor grader 10 receives a circle rotation command. For example, an operator may input a circle rotation command via a joystick or via user interface 104, and the command may be transmitted to controller 102. Alternatively, the circle rotation command may be automatically initiated or received by controller 102 through an automated grading procedure, for example, when motor grader 10 is moving forward and/or executing a programmed procedure.

Next, method 400 may include a step 404, which includes determining whether a load on blade 16 is below a threshold. Step 404 may include blade load sensor 80 transmitting information to controller 102 regarding the current load on blade 16. The load on blade 16 may be measured by load sensor 80. The load on blade 16 may depend on various parameters, such as, for example, engine load information, the height of blade 16 (controlled by lift cylinders 28 and 30) relative to the ground surface and/or motor grader 10, the type of material that motor grader 10 is traversing and/or grading, an angle of blade 16, a pitch of blade 16, a sideshift of blade 16, etc. If the load on blade 16 is below a threshold load, method 400 may proceed to step 406. If, however, the load on blade 16 is equal to or above the threshold load, method 400 may proceed to step 420 and disable rotation of circle 46.

Step 420 includes disabling the circle rotation. Step 420 may include disabling the circle rotation command, for example, by canceling or disabling a user input. Step 420 may include disabling circle drive motor 48. Alternatively or additionally, step 420 may include disconnecting a gearing connection between circle drive motor 48 and circle 46, for example, by disconnecting the gearing connection between circle drive motor 48 and gear box 50, which may allow for free movement of blade 16 or may trigger blade 16 to lock in the current position or in a predetermined position.

In one aspect, the threshold load on blade 16 may correspond to or be equal a threshold load or torque on one or more components of circle drive system 40. For example, the threshold load may correspond or be equal to a threshold load or torque on circle drive motor 48, one or more slip clutches within gear box 50, and/or the connection between circle drive motor 48 or gear box 50 and circle 46. In one aspect, the threshold load may be equal to or less than to a maximum torque that a component of circle drive system 40 can withstand. Alternatively, the threshold load may be manually or automatically adjustable based on the type of motor grader 10, the type and/or temperature of material being traversed and/or graded, or other factors. For example, user interface 104 may allow the operator to select a severe grading application to be implemented by controller 102, in which the operator may specify the material being graded, the severity of the grading application, and/or the threshold load on blade 16. In one example, the threshold load on blade 16 may be lower when grading hard rocky material or frozen ground, and the threshold load on blade 16 may be higher when grading soft gravel or snow. In this aspect, hard rocky material or frozen ground may be more difficult to grade, may be graded at a higher speed, and/or may require greater downforce on blade 16, and thus may impart a greater load on blade 16. Soft gravel or snow may be easier to grade, may be graded at a lower speed, and/or may require less downforce on blade 15, and thus may impart a lower load on blade 16.

A step 406 may include initiating a rotation of circle 46. For example, controller 102 may signal circle drive motor 48 to rotate circle 46 (e.g., via gear box 50). As mentioned, rotation of circle 46 may include an output shaft from circle drive motor 48 or gear box 50 engaging with and driving teeth on circle 46.

Next, step 408 may include determining whether the circle angle is changing. For example, controller may receive one or more signals from circle angle sensor 52 regarding the angle of circle 46 before step 406 and during and/or after step 406. If the angle of circle 46 is changing, method 400 may proceed to step 410. If, however, the angle of circle 46 is not changing, method 400 may proceed to step 420 and disable the rotation of circle 46.

Step 410 may include determining whether the circle angle is changing in the correct direction. As with step 408, in step 410 controller 102 may receive one or more signals from circle angle sensor 52 regarding the angle of circle 46 before step 406 and during and/or after step 406. If the angle of circle 46 is changing in the correct direction based on the circle rotation instruction of step 406, method 400 may proceed to step 412. If, however, the angle of circle 46 is not changing in the correct direction, method 400 may proceed to step 420 and disable the rotation of circle 46.

Next, step 412 may include determining whether the circle rotation command is complete. For example, if the initiated circle rotation command of step 406 instructed to rotate circle 46 to a 15 degree angle, and circle angle sensor 52 now indicates that circle 46 is at a 15 degree angle, then the circle rotation command is complete. If the circle rotation is complete, method 400 may proceed to step 420 and disable the circle rotation. If, however, the circle rotation is not complete, method 400 may return to step 404 and continue the blade monitoring and rotation steps discussed above in order to complete the circle rotation command.

In addition to the steps discussed above, method 400 may include an additional step of continuing to monitor the angle of circle 48, for example, via circle angle sensor 52, during a grading procedure. Moreover, method 400 may include displaying the steps and/or results of the steps on user interface 104 to provide feedback regarding the grading procedure to the operator. For example, if step 404 determines that the load on blade 16 is above the threshold and method 400 proceeds to step 420, an alert or notification may be displayed on user interface 104 that the circle rotation has been disabled. In response, the operator may input one or more controls to reposition blade 16 (e.g., to lift blade 16 via lift cylinders 28 and 30), to stop motor grader 10, and/or make other adjustments.

Method 400 may be performed during the initiation of a grading procedure. In another aspect, method 400 may be continuously or periodically performed through the entirety of the grading procedure in order to adjust and monitor the angle of circle 46, and thus, of blade 16. For example, if the load on blade 16 exceeds the threshold or if the circle 46 is improperly positioned, controller 102 may signal user interface 104 to alert the operator and/or may stop motor grader 10. Furthermore, in yet another aspect, method 400 may be initiated and performed during any rotation or adjustment of circle 46 during the grading procedure and/or any movement of motor grader 10.

Method 400 and the various aspects of motor grader 10 discussed herein may help prevent damage to blade 16, circle 46, circle drive motor 48, and other components of motor grader 10. For example, by determining whether the load on blade 16 is below a threshold in step 404, method 400 may help prevent circle drive motor 48 from rotating circle 46 when blade 16 is already heavily engaged with the ground surface. In one aspect, circle drive system 40 may be large or very powerful to generate torque on circle 46. However, if blade 16 is engaged with the ground surface such that blade 16 cannot move during a circle rotation command, then driving circle drive motor 48 may cause one or more components of circle drive motor 48 to slip, wear, generate excess heat, break, etc. Additionally, by determining whether the angle of circle 46 is changing in step 408 and by determining whether the angle of circle 46 is changing in the correct direction in step 410, method 400 may help prevent circle drive motor 48 from rotating circle 46 when blade 16 is stuck or heavily engaged with the ground surface during the rotation, which may help prevent wear or damage as discussed above. Wear or damage to blade 16, circle 46, circle drive motor 48, and gear box 50, or another component of motor grader 10 may necessitate expensive or time-consuming repairs or otherwise affect the performance of motor grader 10. Moreover, the status of motor grader 10 and method 400 may be displayed on user interface 104 to provide feedback to the operator.

It is noted that motor grader 10 may include any number of circle drive systems 40. The circle drive system(s) 40 may be coupled to various portions of circle 46, and each circle drive system 40 and the components of each circle drive system 40 may be different sizes. Furthermore, controller 102 may be coupled to the one or more circle drive system(s) 40 and perform method 400 in order to help prevent damage to circle drive system(s) 40 and motor grader 10.

It will be apparent to those skilled in the art that various modifications and variations can be made to the disclosed machine without departing from the scope of the disclosure. Other embodiments of the machine will be apparent to those skilled in the art from consideration of the specification and practice of the circle drive control system for a grading machine disclosed herein. It is intended that the specification and examples be considered as exemplary only, with a true scope of the disclosure being indicated by the following claims and their equivalents.

What is claimed is:

1. A control system for a grading machine, the control system comprising:

a circle angle sensor coupled to a circle, wherein the circle is coupled to and supports a grading blade, and wherein the circle angle sensor is configured to measure an angular position of the circle;

a blade load sensor configured to measure a load on the grading blade;

a circle drive system including a circle drive motor, wherein the circle drive motor is configured to engage with and rotate the circle around a circle axis; and a controller, configured to:

control a rotation of the circle by monitoring the angular position of the circle and monitoring the load on the grading blade, wherein the rotation of the circle is based on a circle rotation command, and wherein, to control the rotation of the circle, the controller is configured to:

disable the circle rotation command based on the load on the grading blade exceeding a threshold.

2. The control system of claim 1, wherein the threshold load is equal to or less than a maximum torque that a component of the circle drive system can withstand.

3. The control system of claim 1, wherein the threshold is adjustable based on at least one of a type of grading procedure or a type of material being graded.

4. The control system of claim 1, wherein, based on the circle rotation command, the controller is further configured to determine whether the circle is rotating and whether the circle is rotating in a correct direction that corresponds to the circle rotation command.

5. The control system of claim 4, wherein, the controller is further configured to disable the circle rotation command further based on determining that the circle is not rotating or that the circle is not rotating in the correct direction.

6. The control system of claim 1, further comprising:

a user interface in communication with the controller.

7. The control system of claim 6, wherein, based on the circle rotation command, the controller is further configured to determine whether the circle is rotating and whether the circle is rotating in a correct direction that corresponds to the circle rotation command, wherein the controller is further configured to:

disable the circle rotation command further based on determining that the circle is not rotating and/or that the circle is not rotating in the correct direction, and provide one or more alerts or one or more notifications via the user interface.

8. The control system of claim 1, wherein the circle drive system further includes a gear box that is coupled to the circle drive motor and engages with the circle, and wherein, to disable the circle rotation command, the controller is further configured to:

disconnect one or more gear connections between the circle drive motor and the circle.

9. A method for operating and monitoring a grading machine, the method comprising:

receiving a circle rotation command, wherein the circle rotation command includes a positioning of a circle coupled to a grading blade;

determining whether a load on the grading blade does not exceed a threshold;

based on determining that the load on the grading blade does not exceed the threshold, initiating the circle rotation command by driving the circle with a circle drive system; and based on determining that the load on the grading blade exceeds the threshold, disabling the circle rotation command.

10. The method of claim 9, further comprising:

determining whether an angle of the circle is changing; and based on determining that the angle of the circle is not changing, disabling the circle rotation command.

11. The method of claim 10, further comprising:

determining whether the angle of the circle is changing in a direction that corresponds to the circle rotation command; and based on determining that the angle of the circle is changing in a direction that does not correspond to the circle rotation command, disabling the circle rotation command.

12. The method of claim 11, further comprising:

determining whether the circle rotation command is complete; and based on determining that the circle rotation command is complete, disabling the circle rotation command.

13. The method of claim 9, wherein disabling the circle rotation command includes:

disconnecting one or more gear connections between the circle drive system and the circle.

14. The method of claim 9, further comprising:

monitoring the load on the grading blade and an angle of the circle during a grading operation; and, displaying an alert on a user interface based on:

the load on the grading blade exceeding the threshold, or the angle of the circle changing in a direction that does not correspond to the circle rotation command.

15. The method of claim 14, further comprising:

automatically stopping the machine if the load on the grading blade exceeds the threshold or if an angle of the circle does not correspond to the circle rotation command.

16. The method of claim 9, wherein the threshold is based on one or more of:

a maximum torque that a component of the circle drive system can withstand, a type of grading procedure, or a type of material being graded.

17. A control system for a grading machine, the control system comprising:

a blade load sensor configured to measure a load on a grading blade supported by the circle:

a circle drive system including a circle drive motor, wherein the circle drive motor is configured to engage with and rotate the circle around a circle axis; and a controller configured to:

control a rotation of the circle based on the load on the grading blade, wherein, to control the rotation of the circle, the controller is configured to:

disable the circle rotation command based on the load on the grading blade exceeding a threshold.

18. The control system of claim 17, wherein, based on the circle rotation command, the controller is configured to:

determine whether the circle is rotating in a correct direction that corresponds to the circle rotation command, and wherein, based on determining that the circle is not rotating in the correct direction, the controller is configured to disable the circle rotation command.

19. The control system of claim 17, wherein the controller is further configured to:

determine whether the circle is rotating based on the circle rotation command, and disable the circle rotation command based on determining that the circle is not rotating.

20. The control system of claim 17, wherein the threshold is based on one or more of:

a maximum torque that a component of the circle drive system can withstand, a type of grading procedure, or a type of material being graded.

* * * * *